US008628366B2

(12) United States Patent
Pope

(10) Patent No.: US 8,628,366 B2
(45) Date of Patent: Jan. 14, 2014

(54) AQUATIC EXERCISE DEVICE

(76) Inventor: Kenneth Pope, Stockbridge, GA (US)

( * ) Notice: Subject to any disclaimer, the term of this patent is extended or adjusted under 35 U.S.C. 154(b) by 180 days.

(21) Appl. No.: 13/278,307

(22) Filed: Oct. 21, 2011

(65) Prior Publication Data

US 2012/0164899 A1 Jun. 28, 2012

Related U.S. Application Data

(60) Provisional application No. 61/426,238, filed on Dec. 22, 2010.

(51) Int. Cl.
*B63C 9/08* (2006.01)

(52) U.S. Cl.
USPC ..... 441/129

(58) Field of Classification Search
USPC ..... 441/129
See application file for complete search history.

(56) References Cited

U.S. PATENT DOCUMENTS

| | | | | |
|---|---|---|---|---|
| 4,932,912 | A | 6/1990 | Combs | |
| 4,973,279 | A | 11/1990 | Baumann | |
| 5,833,505 | A | 11/1998 | Huang | |
| 5,964,628 | A * | 10/1999 | Scanlon et al. | 441/129 |
| 6,142,843 | A | 11/2000 | Haase | |
| 6,843,695 | B1 * | 1/2005 | Jackson et al. | 441/129 |
| 2001/0044248 | A1 * | 11/2001 | Walsh | 441/66 |

* cited by examiner

*Primary Examiner* — Stephen Avila
(74) *Attorney, Agent, or Firm* — Daniel Boudwin; Global Intellectual Property Agency LLC

(57) ABSTRACT

An aquatic exercise device is provided for assisting a user staying afloat and maintaining balance while performing exercises within a body of water. The device comprises a frame, a contoured body support bar, a pair of handles and a plurality of flotation and balance elements. The frame and body support bar form a "D" shape that surrounds a user's midsection when in use. Handles are disposed along the front of the device so that a user may grip the device to stabilize his or her upper body during use. The frame is encased in floatation foam to provide buoyancy. Additional balance and buoyancy is provided by larger balancing elements disposed around the floatation frame. A user may utilize the device for swimming or exercising in water in a variety of positions, particularly for the elderly, those with limited mobility or those unable to swim independently.

4 Claims, 2 Drawing Sheets

AQUATIC EXERCISE DEVICE

CROSS REFERENCE TO RELATED APPLICATION

This application claims the benefit of U.S. Provisional Application No. 61/426,238 filed on Dec. 22, 2010, entitled "KP Fitness Buoy."

BACKGROUND OF THE INVENTION

1. Field of the Invention

The present invention relates to an aquatic exercise assistive device. More specifically, the present invention relates to a midsection flotation and support device that allows a user with limited mobility to remain balanced and afloat while performing aquatic exercises.

Swimming and water resistive movement is an excellent form of aerobic exercise that is often used in rehabilitative therapy treatments because of the minimal stress swimming causes to joints and bones. By performing designated exercises in water, an injured individual can slowly rebuild strength and flexibility in the injured part of the body. Additionally, elderly and disabled persons may lack the mobility or cardiovascular strength to perform high impact exercises, but may be able to swim for short periods. Performing aquatic exercises may provide a variety of health benefits to such persons; however these benefits may be minimal or even hazardous if the user is unable to stay afloat or maintain balance within the water. Different types of exercises require a user to stay afloat in different positions. In order for an aquatic therapy regiment to be effective, it is necessary that users be able to stay afloat and maintain balance in a variety of positions while they perform their exercises. A device is needed that assists a user with meeting these objectives.

2. Description of the Prior Art

The prior art contains a variety of aquatic exercise devices for providing floatation to swimming users. These devices have familiar design and structural elements for the purposes of providing floatation; however they are not adapted for the task of assisting disabled persons maintain balanced floatation while performing exercises in a body of water.

The present invention provides a buoyant structure comprising a rounded frame surrounded by flotation elements, further comprising upstanding handles for which a user may grasp in order to stabilize the device against the user's body. The device may be positioned in a variety of positions with regard to the user's body, and is ideal for use against the midsection thereof. This position allows the device to support the upper body of a user while he or she swims horizontally and with aid from the buoyant properties of the device. The device is simple in construction, and therefore easily manufactured and low cost. The device is further lightweight and easily transported to and from a pool or similar body of water.

Haase, U.S. Pat. No. 6,142,843 discloses a swimming and gymnastics exercise device comprising a flat base board having a plurality of receiving slots disposed about its surface and a plurality of handle elements which may be removably secured to the base board by inserting the handles through the receiving slots. The device further comprises a balancing member having a "C" shaped cross section that secures to the baseboard by clamping onto the outer edges of a left and right edge of the baseboard. The handle receiving slots are located at a top and bottom end of the device. With the handles and balancing member secured to the device a user may grip the handles and perform swimming exercises. The balancing member reduces tilting and unsteadiness of the baseboard while the device is in use. While an effective gymnastics or swimming support device, its structure differs from the present invention. The device does not include a plurality of supporting rods that surround a user's mid section.

Baumann, U.S. Pat. No. 4,973,279 discloses a swimming board device for being towed by a boat. The device comprises a floating body having a leading edge, a trailing edge, a glass viewing portion having an upper portion and lower portion joined by a mesh material, longitudinal side members, and arcuate handles attached thereto. Rope may be secured to the handle portions and to a boat so that a user holding said handles may be pulled behind the boat while holding onto the floatation device. The device assists a user with staying afloat while swimming behind a boat and also allows a user to view underwater scenes by looking through the glass portions. Baumann does not disclose the use of supporting rods positioned around the midsection of a user. The present invention is ideal for keeping a user balanced and afloat in an upright position within the water, but the device described by Baumann does not include any balancing means nor is it suitable for assisting an upright user above the surface of a body of water.

Combs, U.S. Pat. No. 4,932,912 discloses a swimming device comprising a kickboard having laterally spaced handles disposed on a left and right edge of the same, a plurality of conduits and a trigger means. A user may lie on the kickboard and grip the handles while swimming to facilitate improved floatation. Trigger means are disposed along the handles that operatively connect to said conduits so that depression of the trigger means causes water to be drawn into the conduits from the swimming area and ejected from a nozzle. In this manner a user may swim around the swimming area while projecting water at desired targets. This device is not suited for assisting an exercising user with maintaining a balanced and upright position while performing swimming exercises. Combs does not disclose a plurality of supporting rods positioned around the midsection of a user. Its structure is substantially different than the present invention, as a board is disclosed as opposed to a floating frame of the present invention.

Huang, U.S. Pat. No. 5,833,505 discloses a floating body portion having a plurality of receiving slots disposed about lateral edges, a pivotable cross bat, a plurality of securing bolts, a plurality of plastic sleeves. The device may be used as a kickboard when a user grips the lateral receiving slots like handles and swims with the device under his or her chest. Alternatively the device may be placed between the user's thighs and the crossbar pivoted so that it provides support under a user's upper thighs and prevents the device from slipping, thereby keeping the user's upper legs afloat. Plastic straps may be inserted into the receiving slots to create bands that may be attached to a user's arm or midsection to help the user float while swimming. The bolts may be inserted into recesses within the floating body to allow the device to be secured to other devices, thus creating a swim bed. The swimming device of Huang does not disclose supporting bars positioned around a user's midsection, nor does it disclose the ability to maintain a user in an upright and balanced position within a body of water in a similar fashion as the present invention, which requires not body attachments. Huang further does not disclose the use of upright handles, grippable by a user for increased stability.

The devices disclosed by the prior art do not address the need for providing balanced floatation to users performing rehabilitative exercises. The current invention relates to a device for assisting persons with limited mobility or swimming experience stay afloat while in an upright or prone position. It substantially diverges in design and structural elements from the prior art; consequently it is clear that there is a need in the art for an improvement to the existing aquatic exercise devices. In this regard the instant invention substantially fulfills these needs.

SUMMARY OF THE INVENTION

In view of the foregoing disadvantages inherent in the known types of aquatic exercise devices now present in the prior art, the present invention provides a new balanced floatation structure wherein the same can be utilized for providing convenience for the user when performing swimming exercises in a variety of positions. The device comprises a floatation frame having a contoured body support bar, balancing elements and a pair of handles. The floatation frame and body support bar form a "D" shaped frame that fits around a user's mid section or for prone support therefor. The body support bar is positioned in front of a user and vertical handles are disposed on a left and right side thereof.

The frame and body support bar are encased in floatation foam to provided overall buoyancy of the device and cushioning to body parts of a user that may rest on the frame or body support bar. Balancing elements disposed around the frame provide additional buoyancy and stability. Since the balancing elements are thicker than the foam encasing the frame, the elements provide stability and reduce the risk of overturning. By gripping the handles and leaning his or her forearms against supporting portions of the frame, a user may stay afloat and maintain balance while performing exercises within the water. These capabilities make the device ideal for users with disabilities, for those who may lack the mobility and those who require assistance staying afloat without assistance.

It is therefore an object of the present invention to provide a new and improved aquatic exercise device having all of the advantages of the prior art and none of the disadvantages.

Another object of the present invention is to provide a new and improved aquatic exercise device having a floatation frame that surrounds a user's midsection, thereby allowing the user to rest upper body parts on the frame as needed.

Yet another object of the present invention is to provide a new and improved aquatic exercise device having balancing elements that stabilize the device while it is in use to reduce the risk that the device will be overturned.

Still another object of the present invention is to provide a new and improved aquatic exercise device that assists a user staying afloat and maintaining balance while performing exercises in a variety of positions including the prone and upright positions.

A further object of the present invention is to provide a new and improved aquatic exercise device having resilient and durable construction.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein like numeral references are utilized throughout.

Figure 3:
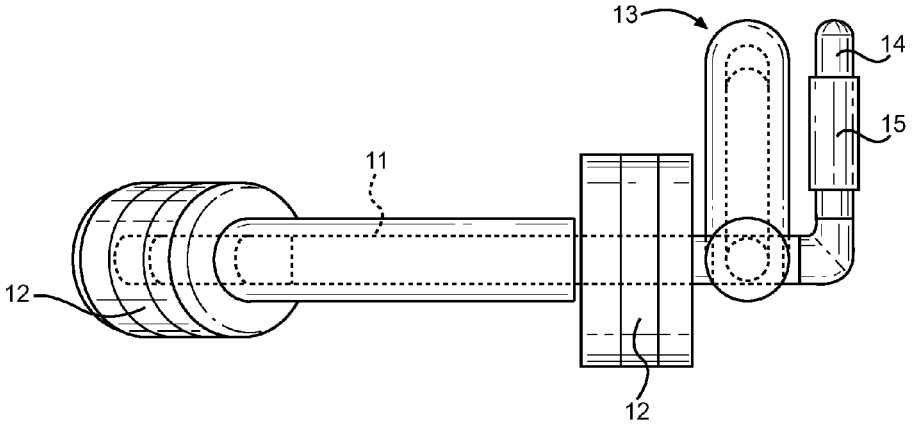

FIG. 3 shoes a side view of the present aquatic exercise device

Figure 4:
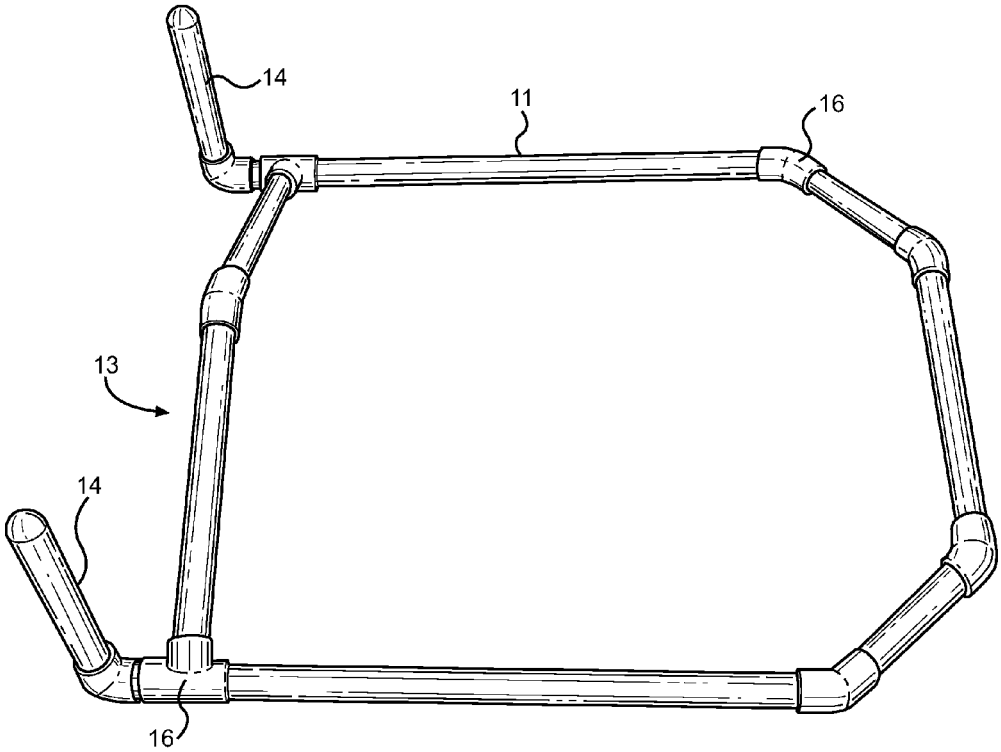

FIG. 4 shows an overhead perspective view of the framework of the present aquatic exercise device.

DETAILED DESCRIPTION OF THE INVENTION

Reference is made herein to the attached drawings. Like reference numerals are used throughout the drawings to depict like or similar elements of the aquatic exercise device. For the purposes of presenting a brief and clear description of the present invention, the preferred embodiment will be discussed as used for assisting a user with maintaining balanced floatation while performing aquatic exercises. The drawings are intended for representative purposes only and should not be considered limiting in any respect.

Figure 1:
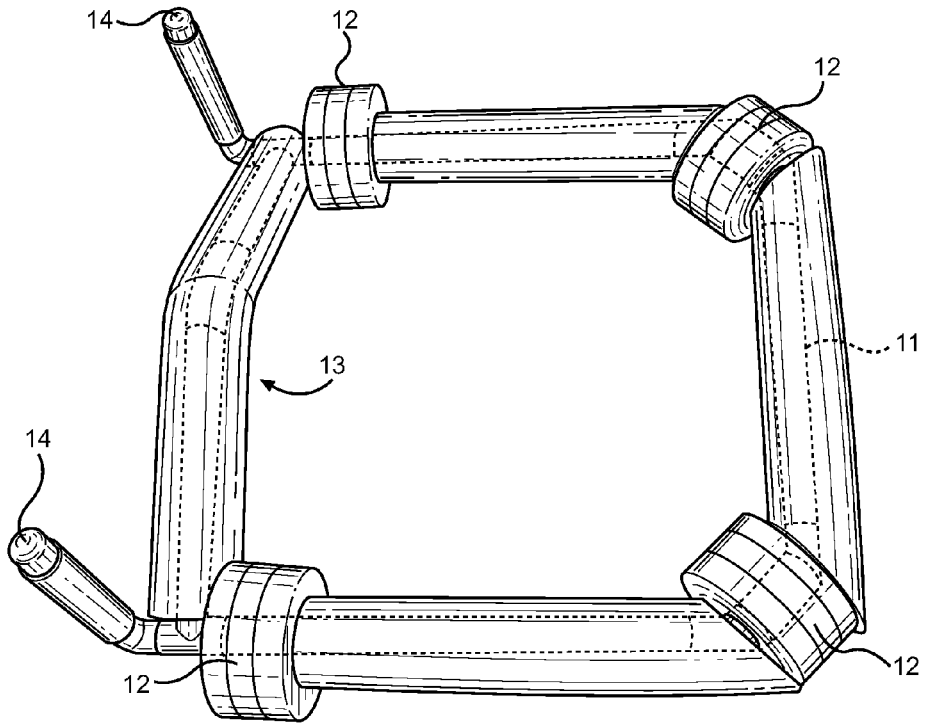
FIG. 1 shows an overhead perspective view of the present aquatic exercise device.

Referring now to FIG. 1, there is shown an overhead perspective view of the aquatic exercise device. The device comprises an inner frame 11, balancing elements 12, a contoured body support bar 13 and a pair of user handles 14. In the water, the device surrounds the midsection of a user or is utilized under a user while in a prone position. The handles 14 are gripped to facilitate the maintenance of balance while the user is exercising. He or she may lean on the body support bar 13 or any portion of the frame 11 to support a part of the body above the water line. The frame is comprised of sections of pipe connected in a D-shape or similar rounded shape. The entire outer surface of the frame 11 is covered in flotation elements that provide buoyancy and cushioning as the user rests thereagainst during operation. Larger balancing elements 12 are provided on the corners of the frame, or are evenly distributed about a frame 11 not having distinct corner regions. These elements 12 assist supporting a user's weight by providing balanced buoyancy to reduce the risk that a user will flip the device while unevenly leaning on a support portion. Thus the device helps a user remain afloat and in a stable condition while in the water and performing exercises in a variety of positions such as prone and upright positions.

Figure 2:
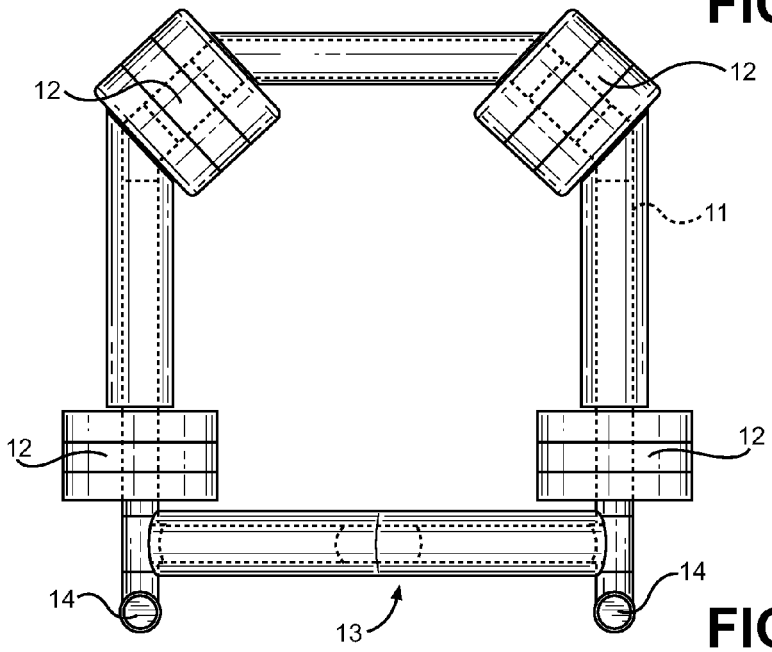
FIG. 2 shows an overhead view of the present aquatic exercise device

Referring now to FIG. 2, there is shown an overhead view of the aquatic exercise device. The frame 11 and forward, contoured body support bar 13 are shown encased in floatation foam. Floatation foam is highly buoyant and provides resistance to the sinking and thus resistance to any downward force exerted by a user's weight in the water. Encasing the frame and body support bar in foam also provides cushioned surfaces for the user to rest parts of his or her body on while performing exercises. When a user is upright in the water, the forearms rest may against longitudinal supporting elements of the frame. The forearms bear the user's weight and can become sore after extended use without proper cushioning. When a user is exercising in a prone position on top of the device, the body support bar may support the user's head or upper chest. These areas are sensitive and require padding to prevent discomfort, pressure points or injury. Floatation foam minimizes discomfort to a user by cushioning the load bearing surfaces of the device and spreading the user's load over a greater surface area.

Along the front of the device, a pair of balancing elements 12 is disposed. A first element is disposed on the left corner portion of the frame 11 and a second floatation element is disposed on the right corner portion. A second pair of balancing elements is disposed in the rear left and right corners of the frame to provide a symmetric and evenly distributed set of balancing elements for stability. These elements are thicker than the floatation foam encasing the frame 11. They provide increased buoyancy and balance to the device to reduce the risk of flipping or overturning the device to one side while exercising in the water. The balancing elements may be made of similar floatation foam, water weights or any other buoyant or stabilizing structure suitable for balancing the device on the surface of water. For embodiments of the frame that do not incorporate a symmetric structure or one without defined corners, the balancing elements need only be evenly distributed with respect to the device center of mass to affect stable buoyancy. Further still, and embodiment of the device may be provided without complete coverage of flotation elements, but rather a set of discrete balancing elements that provide buoyancy and stability.

Referring now to FIG. 3 there is shown a side view of the aquatic exercise device. Balancing elements 12 are disposed along the frame 11 to provide balance and a contoured body support bar 13 and handles 14 are positioned along the front of the device to provide support for a user. The handles are upstanding sections of the frame that secure thereto by a connecting section of frame. Handle grips 15 may encase a portion of the handles to provide a user with a soft, grippable surface to grasp. The handle grips 15 promote a firmer hold on the handles 14 and thereby reduce the chance that a user's fingers will slide therefrom when wet. When the device is placed in water, a user grips the handles to assist with maintaining balance and to position the device as required for exercises that are to be performed.

Referring now to FIG. 4 there is shown an overhead perspective view of the aquatic exercise device frame 11 without flotation foam or balancing elements. The frame 11 comprises a plurality of interconnected support bars secured together to form a rounded structure. The preferred embodiment of the frame shape is that of a "D" shape. The frame 11 may comprise of a unitary structure, preformed to a specific shape, or preferably be constructed of a plurality of constituent members that interconnect to form the frame shape. In this preferred embodiment, connector elements 16 are disposed at the termination of each supporting bar to provide a connection bridge to an adjacent support bar element. In the embodiment illustrated in FIG. 4, left and right side elements are secured to short supporting bar portions by angled connecter pipes having an angle. These short supporting bar portions are further connected by angled connecters elements to the back portion of the device. The longitudinal bars, short bar portions and back portion form a generally "U" shaped frame, which is closed off by an angled section forming the body support bar 13. Upstanding handles 14 are secured frame to provide handle extensions. The exact construction of the frame elements may take any form that provides a rounded, closed loop with handle extensions and a cross section easily encased in flotation foam elements.

The body support bar 13 has preferably an inverted "V" shape that provides support to the head or chest of a user swimming in the prone position, thereby keeping the head above the water line. Additionally, the shape of the body support bar 13 allows a user to perform leg exercises in front of the body without kicking the device. The frame 11 may be constructed from hollow PVC piping with closed ends to prevent water introduction therein while in use.

In use an individual enters the water and places the device over their head, lowering it to the water line for placement around his or her waist. The user may then walk to an area of desired depth while holding onto the device. The user may take hold of the handles, gripping them by the handle grips and leaning his or her forearms on the side sections of the frame. With the user's weight thus supported, he or she may begin to exercise in an upright position. To exercise in the prone position, the user simply leans forward and rests his or her head or chest on the forward, body support bar and kicks his or her legs out the rear. In this manner, the device assists a user with staying afloat and maintaining balance while swimming or exercising in a body of water.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim the following:

1. An aquatic exercise device, comprising:

a d-shaped frame comprising a plurality of support bars forming a closed loop, said frame having a forward section, a rear section and two laterally opposing side sections, and wherein said side sections extend past said forward section;

said frame forward section comprising a contoured body support bar forming a vertically oriented inverted V-shape, a pair of upstanding handles disposed at forward terminal ends of said side sections along said frame forward section;

a plurality of balancing elements disposed along said frame to provide balanced buoyancy of said frame.

2. The device of claim 1, wherein said frame and said contoured body support bar further comprise flotation elements disposed about its outer surface.

3. The device of claim 1, wherein said handles further comprise handle grips to provide a surface having a higher degree of friction and grip.

4. The device of claim 1, wherein said frame further comprises a hollow, closed inner section to prevent water infiltration.

* * * * *